US006135023A

United States Patent [19]

Sato

[11] Patent Number: 6,135,023

[45] Date of Patent: Oct. 24, 2000

[54] STENCIL PRINTING MACHINE HAVING MECHANISM FOR ADJUSTING GAP BETWEEN SQUEEGEE AND DOCTOR ROLLERS

[75] Inventor: Shiro Sato, Ibaraki-ken, Japan

[73] Assignee: Riso Kagaku Corporation, Tokyo, Japan

[21] Appl. No.: 09/410,633

[22] Filed: Oct. 4, 1999

[30] Foreign Application Priority Data

Oct. 12, 1998 [JP] Japan ..... 10-289507

[51] Int. Cl.[7] ..... B41L 13/18; B41F 31/34

[52] U.S. Cl. ..... 101/120; 101/351.1; 101/352.01; 101/116

[58] Field of Search ..... 101/116, 119, 101/120, 351.1, 351.2, 352.01, 352.02, 352.03, 247

[56] References Cited

U.S. PATENT DOCUMENTS

| | | | |
|---|---|---|---|
| 2,383,970 | 9/1945 | Huck | 101/352.01 |
| 5,657,691 | 8/1997 | Kato | 101/120 |
| 5,913,265 | 6/1999 | Ishii et al. | 101/116 |

FOREIGN PATENT DOCUMENTS 0 737 590 10/1996 European Pat. Off. .

OTHER PUBLICATIONS

Patent Abstracts of Japan, vol. 015, No. 318(M–1146), Aug. 14, 1991 & JP03–120073A (Ricoh Co., Ltd.), May 22, 1991.

Patent Abstracts of Japan, vol. 010, No. 295(M–523), Oct. 7, 1986 & JP61–108557 A (Riso Kagaku Corp), May 27, 1986.

*Primary Examiner*—John S. Hilten
*Assistant Examiner*—Leslie J. Grohusky
*Attorney, Agent, or Firm*—Konesaka and Takeuchi

[57] ABSTRACT

A stencil printing machine includes a printing drum having a flexible ink-permeable circumferential wall adapted to receive a perforated stencil sheet around an outer circumferential surface thereof, the printing drum being rotated around a central axis thereof; a squeegee roller having an axis and situated inside the printing drum to be parallel to the central axis of the printing drum, the squeegee roller being rotated around the axis in synchronization with rotation of the printing drum with an outer circumferential surface thereof contacting an inner circumferential surface of the printing drum; a pair of bearing members attached to end portions of the axis of the squeegee roller for rotationally supporting the axis; a doctor roller having an axis and situated parallel to the squeegee roller at a predetermined distance away from the outer circumferential surface of the squeegee roller; a pair of adjusting screws situated perpendicular to the axis of the squeegee roller and fixed to the pair of bearing members, the pair of adjusting screws supporting the axis of the doctor roller so that the axis of the doctor roller is movably supported; a pair of worm wheels engaging the pair of adjusting screws, respectively; a pair of worm gears connected together and engaging the pair of worm wheels, respectively, so that when the pair of worm gears is rotated, the pair of worm wheels is rotated simultaneously.

5 Claims, 14 Drawing Sheets

STENCIL PRINTING MACHINE HAVING MECHANISM FOR ADJUSTING GAP BETWEEN SQUEEGEE AND DOCTOR ROLLERS

BACKGROUND OF THE INVENTION

1. Field of the Invention

The present invention relates to a stencil printing machine such that a squeegee roller with ink provided on an outer circumferential surface thereof contacts an inner circumferential surface of a printing drum, and that the ink is forced to pass through perforations of a stencil sheet to transfer onto a printing sheet, thereby conducting printing. More specifically, the invention relates to an improved mechanism for adjusting a gap between the squeegee roller and a doctor roller that is movable relative to the squeegee roller.

2. Description of the Related Art

A stencil printing machine has a printing drum having a stencil sheet wrapped thereon and a squeegee roller situated inside the printing drum. As illustrated in FIG. 14, an outer circumferential surface of a squeegee roller 1 contacts an inner circumferential surface of a printing drum 3. And, in the printing drum 3, an ink-control device, i.e. a doctor roller 5, is situated parallel to the squeegee roller 1 at a predetermined gap from the outer circumferential surface of the squeegee roller 1. This constitution allows ink to make a wedge-form reservoir 7 (ink reservoir) between the outer circumferential surfaces of the squeegee roller 1 and the doctor roller 5.

In the ink reservoir, an ink mixing shaft 9 is rotatably situated parallel to the squeegee roller 1. The ink mixing shaft 9 has a gear 11 attached to one end thereof. The gear 11 engages with a gear 13 fixed to one end of the squeegee roller 1, thereby being rotated in a direction opposite to that of the squeegee roller 1 in synchronization with rotation of the squeegee roller 1.

During operation of the stencil printing machine, the printing drum 3 rotates in a direction "A" shown in FIG. 14, and the squeegee roller 1 rotates in a direction "B" shown in the same. This movement urges an ink of the ink reservoir 7 to swirl around the ink mixing shaft 9 in a direction "C", thereby forming an ink lump there. The ink forming the lump is supplied by an ink supplying device comprising an ink pump, an ink conducting pipe, and an ink distributing pipe (distributor). These components are not shown in the drawing.

In the stencil printing machine, control of ink-quantity supplied to the squeegee roller 1 is important for ensuring printing quality. The ink-quantity is controlled by a gap between the squeegee roller 1 and the doctor roller 5. Therefore, the doctor roller 5 is supported by a mechanism allowing the roller to move relative to the squeegee roller 1 to adjust the gap.

The mechanism is approximately composed of a bearing member 15 of the squeegee roller 1, an adjusting screw 17 with one end portion screwed in the bearing member 15, an end portion 19 of an axis of the doctor roller 5, and a compression coil spring 21. The adjusting screw 17 passes through a hole formed in the end portion 19, and the compression coil spring 21 is fitted on the adjusting screw between the bearing member 15 and the end portion 19. The other end portion of the adjusting screw 17 is an enlarged head 17*a*. The head 17*a* contacts and holds the end portion 19 of the doctor roller 5, thereby preventing the portion from coming off the adjusting screw 17. In other words, the end portion 19 of the doctor roller 5 is always urged towards the head 17*a* by the compression coil spring 21.

In this state, there is formed a gap in a predetermined width between the squeegee roller 1 and the doctor roller 5. In order to make the gap narrower, the adjusting screw 17 is turned in the screwing direction by a tool such as a screwdriver that is engaged with the head 17*a* on each end of the doctor roller. Then, the end portion 19 of the doctor roller 5 moves towards the bearing member 15 while resisting the urging force of the compression coil spring 21. As a result, the gap becomes narrower. Contrary to this, if the gap is required to become broader, the adjusting screw 17 is turned in the unscrewing direction. Then, the end portion 19 of the doctor roller 5 is moved in a direction departing from the bearing member 15 by urging force of the compression coil spring 21. As a result, the gap becomes broader.

Thus, in the conventional stencil printing machine, the adjusting screws 17 on both end portions of the doctor roller are turned by the tool, thereby moving the doctor roller 5 relative to the squeegee roller 1 to adjust the gap. This operation controls ink-quantity supplied to the squeegee roller, thereby achieving printing of high quality.

In the stencil printing machine, the gap between the squeegee roller and the doctor roller changes according to abrasion of the squeegee roller. However, since adjusting of the gap according to abrasion of the squeegee roller is not frequently required, the gap-adjusting mechanism explained above can facilitate adjusting of the gap due to such abrasion.

However, aluminum or rubber as surface material of the squeegee roller expands and contracts according to environmental temperature. For example, some kind of material among them allows the gap to change by 0.004 mm/° C. On the other hand, an allowable limit to fluctuation of the gap is 0.04 mm. Accordingly, when temperature fluctuates over 10° C., fluctuation of the gap exceeds the allowable limit. This makes printing density in the stencil printing unstable. Therefore, adjusting of the gap according to temperature fluctuation is frequently required.

However, in the conventional gap adjusting mechanism, the gap must be adjusted approximately by 1/100 mm by turning an adjusting screw having pitch of approximately 0.7 mm. Accordingly, the adjusting screw is required to turn in a subtle angle within one rotation, and skilled technique ensured by enough experience and high-sensitivity of an operator is required to conduct such adjusting operation.

Further, in the conventional gap adjusting mechanism, both ends of the doctor roller are adjusted by independent two adjusting screws, respectively. Such adjusting operation is troublesome, and parallelism between the rollers is difficult to be achieved.

Further, in a stencil printing machine such that the squeegee roller moves vertically in the printing drum, the stencil sheet must be removed from the printing drum when the adjusting screw is operated to turn for the gap-adjusting. Namely, the gap-adjusting is accompanied by such additional operation; therefore, it is further troublesome.

More further, in the conventional constitution having the independent two adjusting screws, operation of the gap-adjusting is subtle. And, such constitution is so complicated that it hinders an automatic gap-adjustment system with a motor as a driving source from being realized.

The present invention is made in view of the forgoing. An object of the present invention is to provide a stencil printing machine in which the gap-adjusting can be easily conducted without skilled technique of an operator.

SUMMARY OF THE INVENTION

A stencil printing machine as defined in a first aspect of the present invention comprises a printing drum having a flexible ink-permeable peripheral wall adapted to receive a perforated stencil sheet around an outer circumferential surface thereof the printing drum being rotated around a central axis thereof; a squeegee roller having an axis and situated inside the printing drum to be parallel to the central axis of the printing drum, the squeegee roller being rotated around the axis in synchronization with rotation of the printing drum with an outer circumferential surface thereof contacting an inner circumferential surface of the printing drum; a pair of bearing members attached to end portions of the axis of the squeegee roller for rotationally supporting the axis; a doctor roller having an axis and situated parallel to the squeegee roller at a predetermined distance away from the outer circumferential surface of the squeegee roller; a pair of adjusting screws situated perpendicular to the axis of the squeegee roller and fixed to the pair of bearing members, the pair of adjusting screws supporting the axis of the doctor roller so that the axis of the doctor roller is movably supported; a pair of worm wheels engaging the pair of adjusting screws, respectively; a pair of worm gears connected together and engaging the pair of worm wheels, respectively, so that when the pair of worm gears is rotated, the pair of worm wheels is rotated simultaneously.

Accordingly, in the stencil printing machine of the first aspect, the worm wheel is engaged with the adjusting screw fixed to the bearing portion of the squeegee roller, and the worm gear engages with the worm wheel. Therefore, when the worm gear is rotated in a number identical to a tooth number of the worm wheel, the worm wheel performs one rotation. Hence, even in the case where the adjusting screw has a large pitch, wide adjusting range is assured in adjusting a gap between the squeegee roller and the doctor roller, thereby achieving a subtle adjusting operation.

According to a stencil printing machine as defined in a second aspect of the present invention, in the stencil printing machine of the first aspect, the stencil printing machine further comprises a worm shaft having the pair of worm gears fixed thereto; a counting drive gear coaxially fixed to the worm shaft; and a counting follower gear engaging the counting drive gear, the counting follower gear having a tooth number different from that of the counting drive gear and graduations for indicating a gap between the squeegee roller and the doctor roller, the graduations being formed to have intervals according to difference between rotating number of the counting drive gear and that of the counting follower gear.

According to a stencil printing machine as defined in a third aspect of the present invention, in the stencil printing machine of the second aspect, the stencil printing machine further comprises operating means engaging the counting drive gear to rotate the worm shaft.

Accordingly, in the stencil printing machine of the second and the third aspect, since the pair of adjusting screws is connected with each other by the worm shaft, the pair of adjusting screws can be simultaneously operated in the same rotational angle by turning the worm shaft. And, when the counting drive gear is rotated by the operating means, the counting follower gear that engages with the counting drive gear also rotates. The counting follower gear is shifted from the drive counting gear in the rotational direction according to the tooth-number difference between them. Thus, an operator can recognize an actual length of the gap by reading the graduations of the counting follower gear.

According to a stencil printing machine as defined in a fourth aspect of the present invention, in the stencil printing machine of the first aspect, the stencil printing machine further comprises compression coil springs situated between the axis of the doctor roller and the bearing members, the axis of the doctor roller includes holes formed at end portions thereof, each of the adjusting screws are inserted through the holes, so that the compression coil spring arranged between the axis of the doctor roller and the bearing members urges the doctor roller towards the worm wheel.

Accordingly, in the stencil printing machine of the fourth aspect, the compression coil spring urges the end of the axis of the doctor roller towards the worm wheel, thereby always holding the doctor wheel contacted the worm wheel side, so that fluctuation of the gap due to unnecessary movement of the doctor roller can be prevented.

According to a stencil printing machine as defined in a fifth aspect of the present invention, in the stencil printing machine of the first aspect, the stencil printing machine further comprises a driving motor connected to the worm shaft with the worm gear fixed thereto.

Accordingly, in the stencil printing machine of the fifth aspect, the gap can be automatically adjusted by the worm shaft driven by the motor.

DETAILED DESCRIPTION OF PREFERRED EMBODIMENTS

Figure 1:
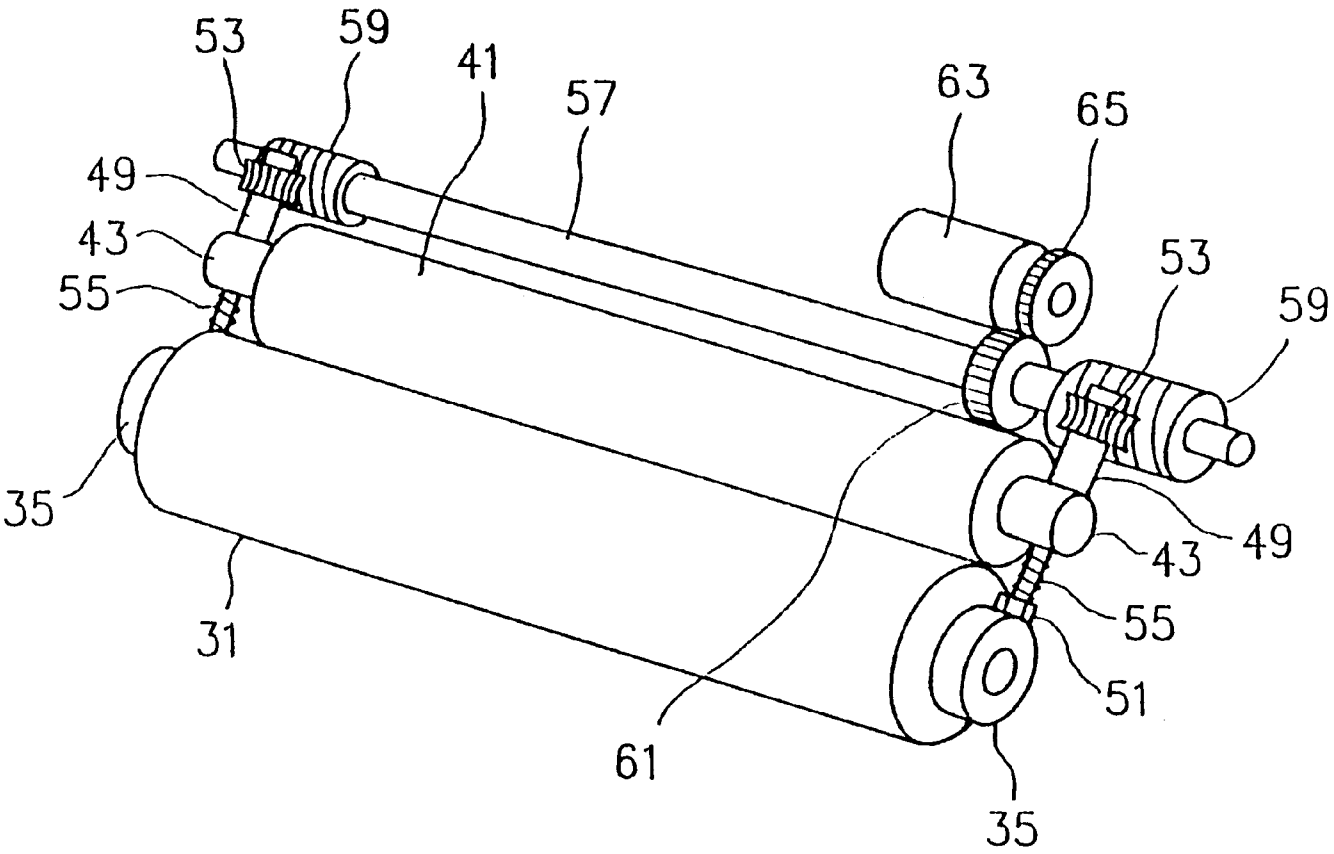
FIG. 1 is a schematic view of a gap-adjusting mechanism of a printing drum in the embodiment of the present invention.

Hereafter, preferred embodiments of a stencil printing machine according to the present invention will be explained in detail referring to the drawings.

Figure 2:
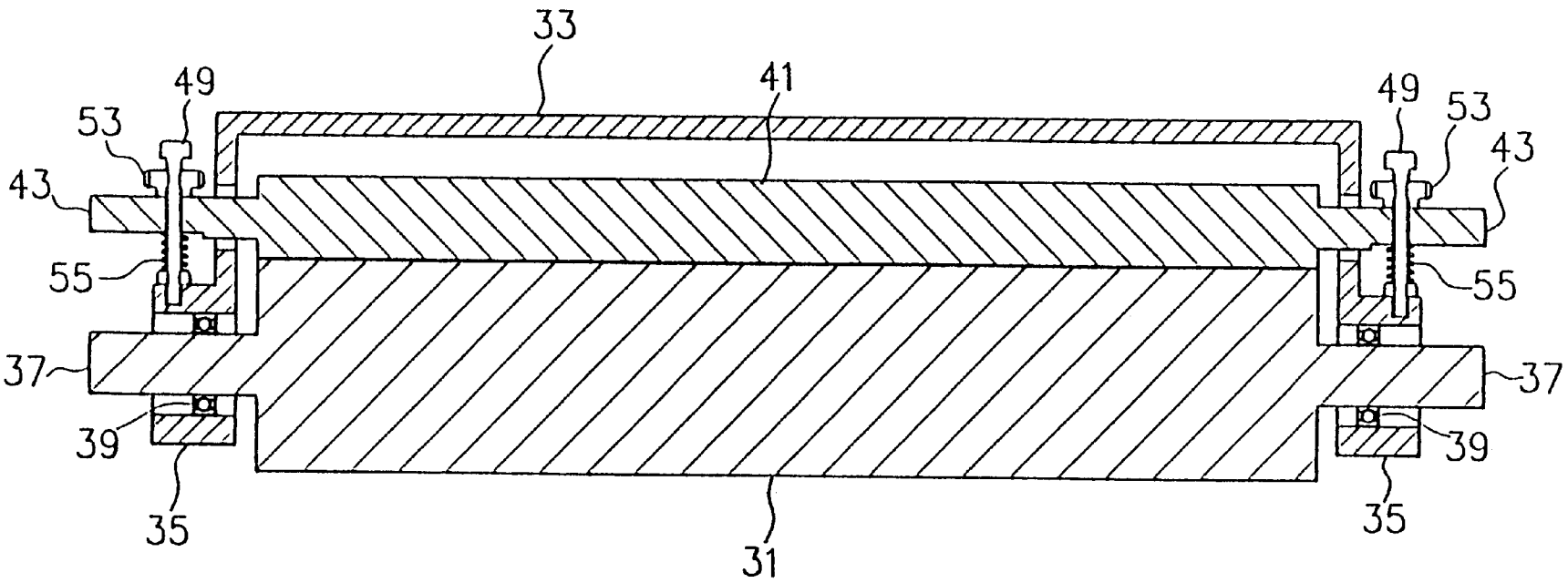
FIG. 2 is a sectional view of a squeegee roller and the vicinity thereof in the embodiment.
Figure 3:
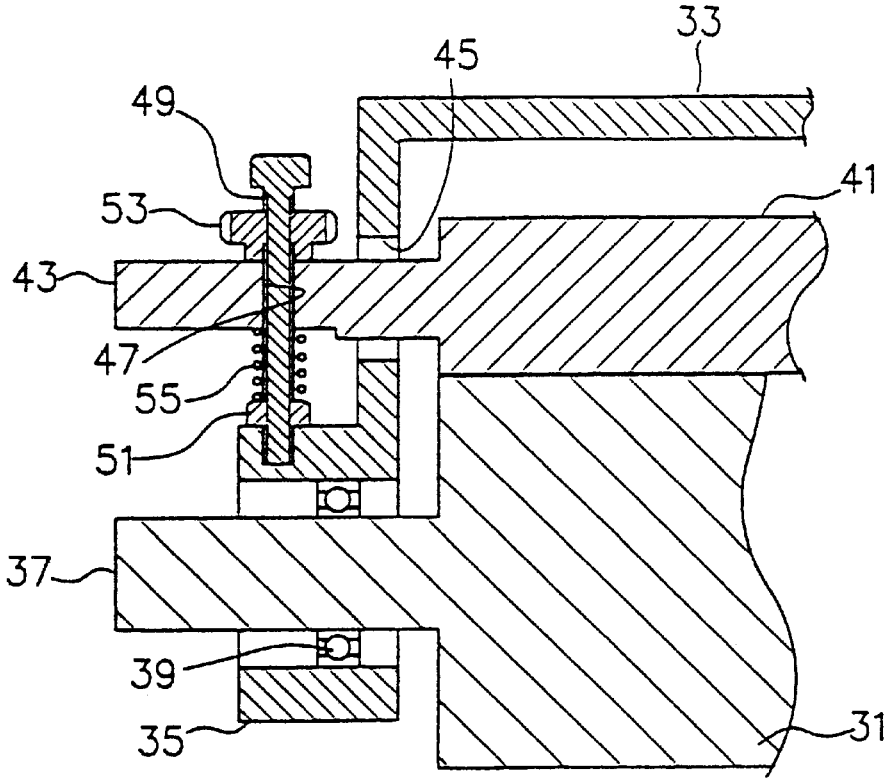
FIG. 3 is an enlarged view showing a part of FIG. 2.
Figure 4:
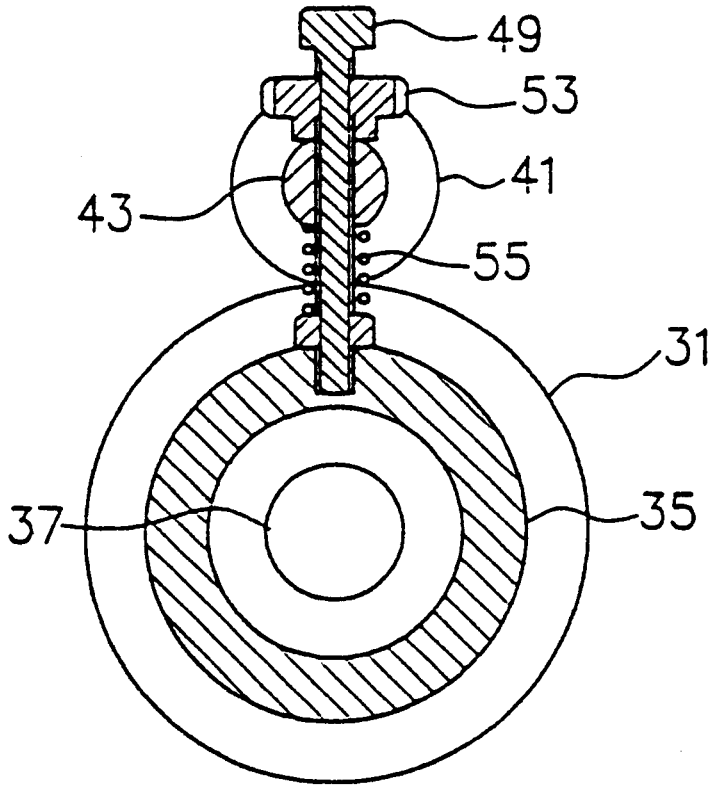
FIG. 4 is a sectional view taken along a longitudinal line in FIG. 2.
Figure 5:
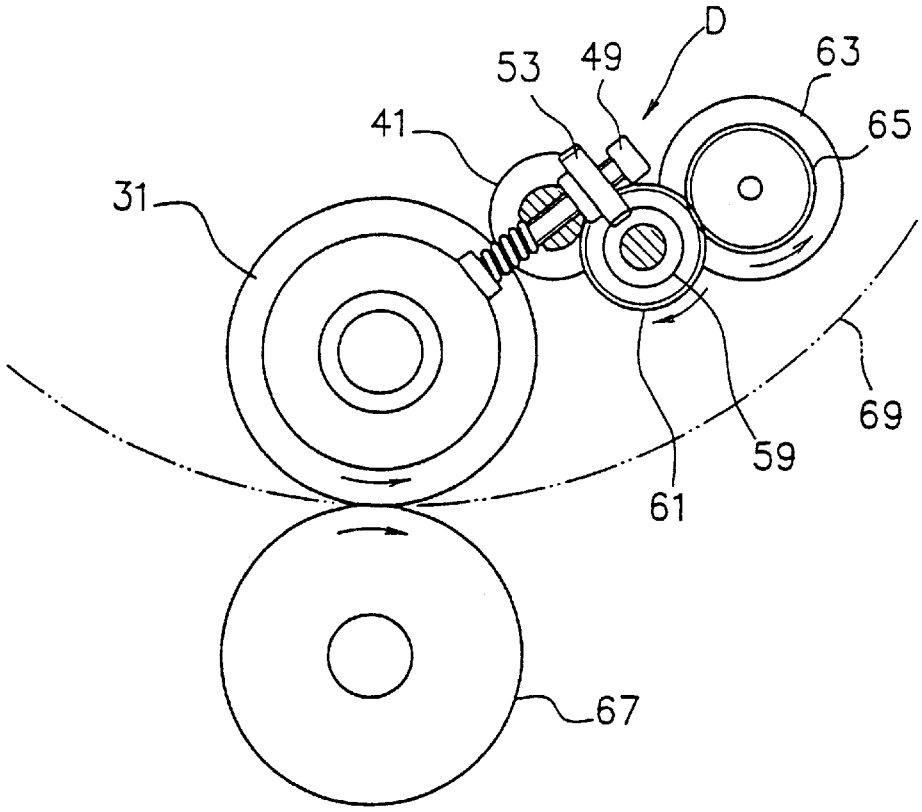
FIG. 5 is a sectional view of a motor driving mechanism.
Figure 6:
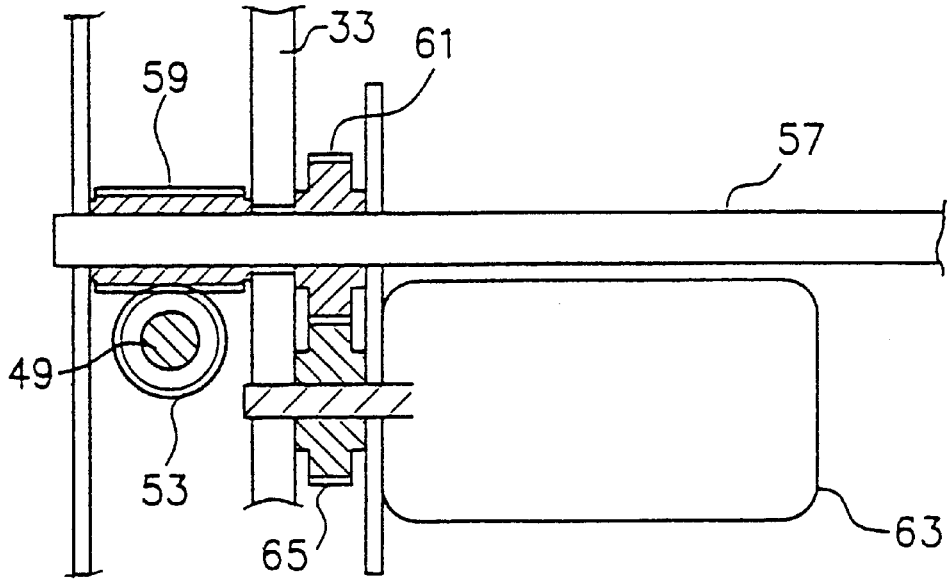
FIG. 6 is a sectional view observed in a direction "D" shown in FIG. 5.

FIG. 1 is a schematic view of a gap-adjusting mechanism of a stencil printing machine according to the present invention. FIG. 2 is a sectional view of a squeegee roller and the vicinity thereof. FIG. 3 is an enlarged view showing a part of FIG. 2. FIG. 4 is a sectional view taken along a longitudinal line in FIG. 2. FIG. 5 is a sectional view of a motor driving mechanism. FIG. 6 is a sectional view observed in a direction "D" shown in FIG. 5.

A stencil printing machine of an outer pressing type has been proposed. The stencil printing machine of such type has a printing drum and a press roller situated vertically movably outside the printing drum. The cylindrical printing drum has a pair of flanges arranged coaxially at both ends thereof and a screen wrapped around outer circumferential surfaces of the flanges. The printing drum is rotatably supported on a central axis that is extended through the flanges and fixed to a not-shown main frame.

Inside the printing drum, a squeegee roller 31 as shown in FIG. 1 is situated. The squeegee roller 31 has an axis 37 that is rotatably supported by a bearing member 39. The bearing member is attached to a receiving portion 35 of an in-drum frame 33 to which the central axis is integrally fixed as illustrated in FIG. 2. Accordingly, in spite of rotation of the printing drum, the squeegee roller 31 supported by the in-drum frame 33 is held in a fixed position and rotates there.

Inside the printing drum, a non-rotatable doctor roller 41 is situated parallel to the squeegee roller 31. The doctor roller 41 is a solid cylinder narrower than the squeegee roller 31. The doctor roller has an axis 43 extending from end portion thereof, and the axis passes through a supporting hole 45 formed in the in-drum frame 33 as shown in FIG. 3. The supporting hole 45 is formed larger than the diameter of the axis 43. Accordingly, the doctor roller 41 can move parallel to the squeegee roller within a range that the axis 43 thereof contactes an inner surface of the supporting hole 45.

Each of both ends of the axis 43 extends outside the in-drum frame 33 through the supporting hole 45. In the end of the axis 43, a through hole is formed in a direction perpendicular to the axis 43. An adjusting screw 49 passes through the hole 47. A nut 51 is fixed to the receiving portion 35, and one end of the adjusting screw passing through the hole 47 is fixed to the nut 51. The through hole 47 is formed larger than the diameter of the adjusting screw 49. Accordingly, the axis 43 can slide relative to the adjusting screw 49 in an axial direction of the adjusting screw 49.

The other end of the adjusting screw 49 is an enlarged head portion, and a worm wheel 53 is screwed on the adjusting screw 49 just under the head portion. Thus, the doctor roller 41 can not come out of the adjusting screw 49 since the axis 43 is held by the worm wheel 53 while contacting it. A compression coil spring 55 is fit on the outer circumferential surface of the adjusting screw 49 while being compressed between the axis 43 and the nut 51. Accordingly, the axis 43 is always pressed against the worm wheel 53 by urging force of the compression coil spring 55.

In assembling the stencil printing machine, a pair of the adjusting screws 49 is turned and forced into a pair of the receiving portions 35, respectively, in the same depth. Thus, a longitudinally constant gap is formed between the doctor roller 41 and the squeegee roller 31.

A worm shaft 57 is situated adjacent to and parallel to the doctor roller 41. The worm shaft 57, as shown in FIG. 6, is rotatably supported on the in-drum frame 33 at both ends thereof. A pair of worm gears 59 is fixed to the both ends of the worm shaft 57, respectively. Each worm gear 59 engages with a worm wheel 53 screwed on the adjusting screw 49.

A driven gear 61 is fixed to one end side of the worm shaft 57. A drive motor 63 is fixed to the in-drum frame 33. A drive gear 65 is fixed to a driving axis of the drive motor 63. And, the drive gear 65 engages with the driven gear 61. Thus, when the drive motor 63 is energized to rotate the drive gear 65, the worm shaft 57 is driven to rotate with the driven gear 61, and then the worm wheel 53 is rotated by the worm gear 59 fixed on the worm shaft 57.

By rotating the worm wheel 53, the adjusting screw 49 is moved in an axial direction thereof relative to the worm wheel. This operation changes distance between the worm wheel 53 and the nut 51, thereby moving the axis 43 that is pressed against the worm wheel. Thus, the doctor roller 41 approaches or departs from the squeegee roller 31 while being held parallel thereto. Accordingly, the gap between the squeegee roller 31 and the doctor roller 41 can be adjusted. Additionally, reference numerals 67 and 69 indicate a press roller and a screen, respectively.

Next, driving control of the drive motor 63 will be explained.

Figure 7:
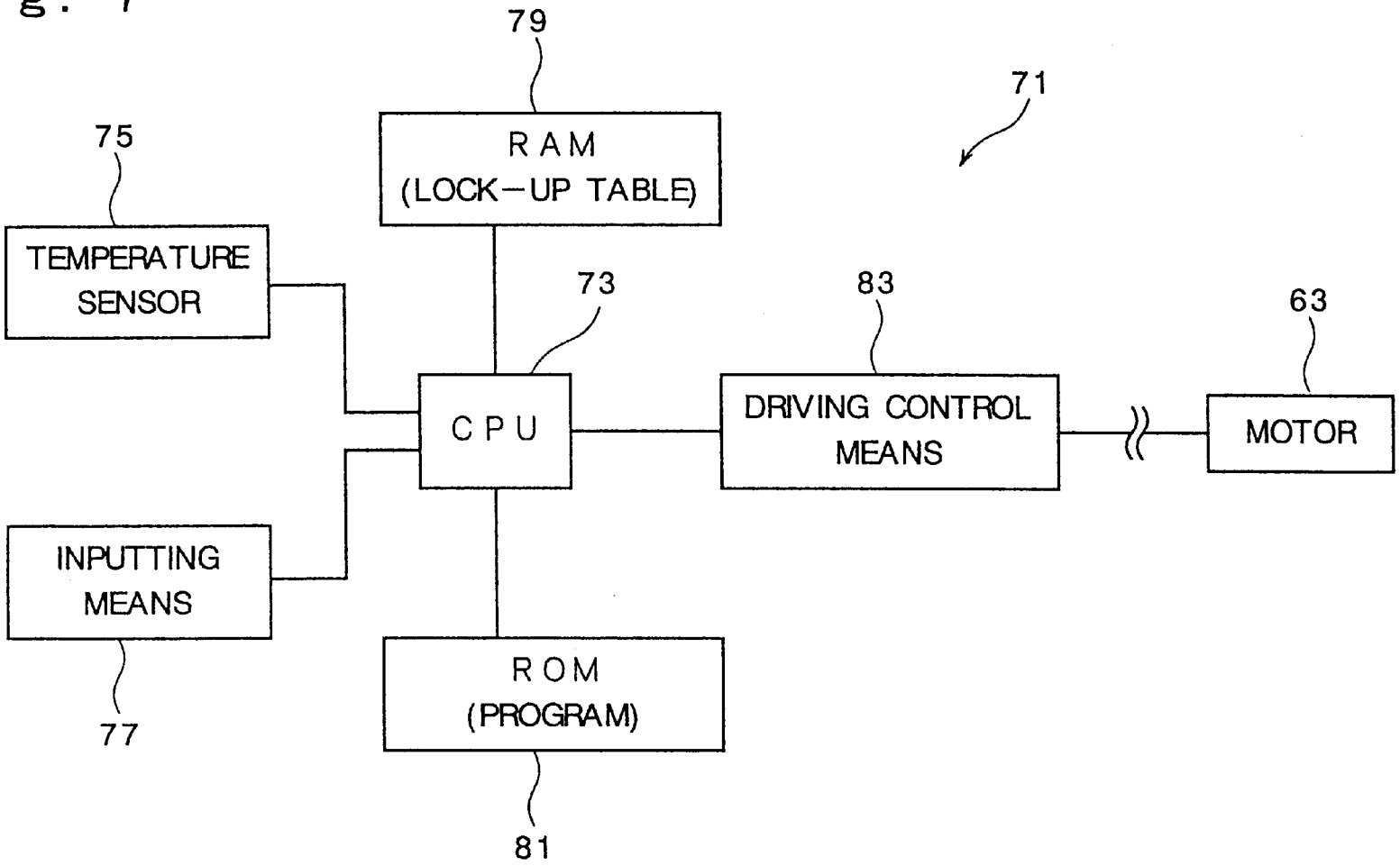
FIG. 7 is a block diagram showing a schematic constitution of control means in the embodiment.

FIG. 7 is a block diagram showing a schematic constitution of a controller.

The controller 71 is mainly composed of a CPU 73, a temperature sensor 75 electrically connected to the CPU 73, an inputting means 77, a RAM 79, a ROM 81, and driving control means 83.

The temperature sensor 75 detects atmospheric temperature inside the machine. The inputting means 77 inputs printing density value into the CPU 73 when being operated from outside. The RAM 79 includes a look-up table storing thermal expansion coefficients of the squeegee roller 31 and the doctor roller 41 according to temperature. The ROM 81 stores a program for controlling the gap-adjustment. The driving control means 83 transmits a driving control signal to the drive motor 63 according to a control signal output from the CPU 73.

Next, procedure of the gap adjustment where the controller 71 controls the drive motor 63 will be explained.

Figure 8:
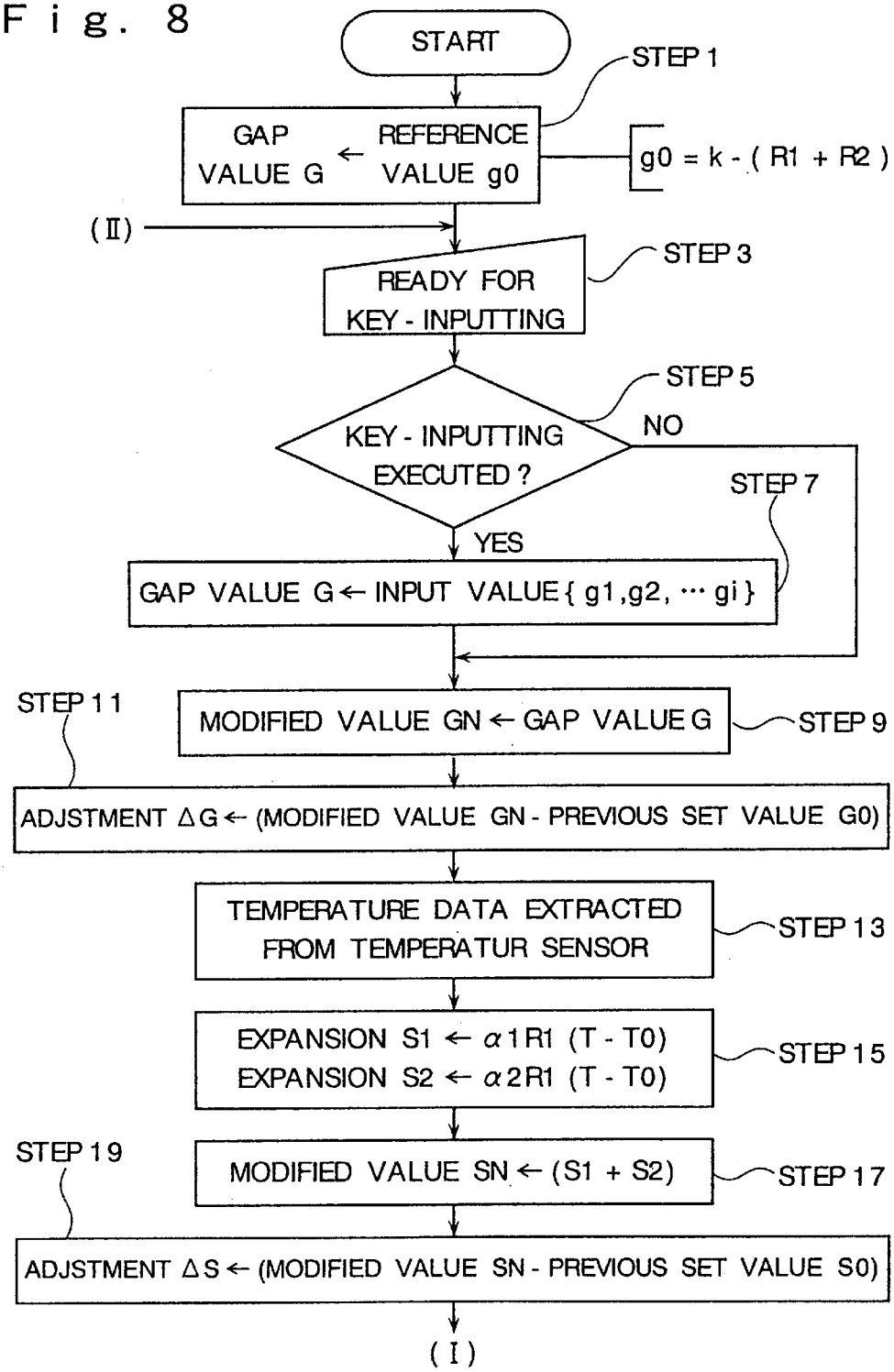
FIG. 8 is a flow chart showing control procedure (1) in the embodiment.
Figure 9:
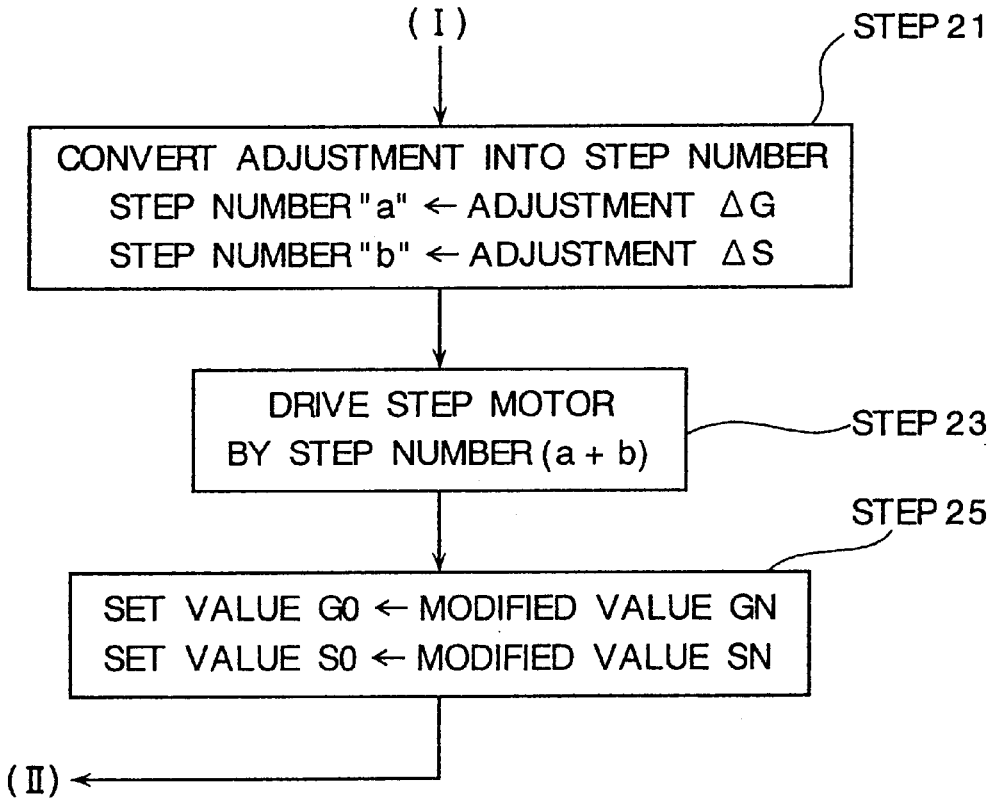
FIG. 9 is a flow chart showing control procedure (2) in the embodiment.

FIG. 8 is a flow chart of a control procedure (1). FIG. 9 is a flow chart of a control procedure (2). Reference (I) in FIG. 8 is linked to reference (I) in FIG. 9. Reference (II) in FIG. 9 is linked to reference (II) in FIG. 8.

When the program is started, a pre-stored reference value g0 is set as a gap value G (STEP 1). The reference value g0 is calculated in such a manner that a sum of a radius R1 of the doctor roller 41 and a radius R2 of the squeegee roller 31 is subtracted from a constant k.

Next, after confirming the state where key-inputting is ready (STEP 3), whether key-inputting is executed is judged. In the case where "key-inputting is executed", an input value selected from g1, g2, . . . gi is set as the gap value G (STEP 8). The input value set as the gap value G is stored as a modified value GN (STEP 9). In the case where key-inputting is not executed, the reference value g0 set as the gap value G is stored as the modified value GN.

Next, a previous set value GN is subtracted from the modified value GN to produce a difference, and the difference is set as an adjustment ΔG (STEP 11). And then, temperature data indicating temperature inside the machine is extracted by the temperature sensor 75 (STEP 13).

The CPU 73 refers to a look-up table inside the RAM 79 and extracts coefficient of thermal expansion for the doctor roller 41 and the squeegee roller 31 according to the detected temperature. The CPU 73 calculates expansion S1, S2 of the doctor roller 41 and the squeegee roller 31, respectively, by using the coefficient of thermal expansion (STEP 15).

According to the expansion S1, S2, a modified value SN is set (STEP 17). A previous set value S0 is subtracted from the modified value SN to produce a value, and the value is set as an adjustment ΔS (STEP 19).

Next, the CPU 73 calculates step numbers "a" and "b" for driving the drive motor 63 according to the adjustments ΔG and ΔS, respectively (STEP 21). Next, the CPU 73 drives the drive motor 63 through the driving control means 83 by a step number gained from a sum of "a" and "b". Accordingly, the gap is adjusted to the input value modified by the atmospheric thermal expansion of the squeegee roller 31 and the doctor roller 41.

Next, the present modified values GN and SN are set as the set values G0 and S0, respectively (STEP 25). Again, procedure is returned to the processing, "Ready for Key-inputting" of STEP 3. Then, the same procedure will be conducted as explained above.

Thus, in such control conducted by the controller 71, expansion of the rollers is corrected according to a present atmospheric temperature, so that the gap is adjusted. In this way, the gap is always precisely adjusted in spite of fluctuation of an atmospheric temperature.

Although the adjusting screw 49 with a large pitch similar to the related art is used in the stencil printing machine thus constituted, this adjusting screw 49 has the worm wheel 53 attached thereto, and the worm wheel 53 engages the worm gear 59. Therefore, the worm wheel 53 rotates by an angle of one tooth when the worm gear 59 makes one rotation. For example, if the worm wheel 53 has twenty teeth, the worm gear 59 is required to be rotated twenty times in order to rotate once the worm wheel 53. That is, adjusting range is enlarged twenty times, so that a subtle adjustment can be conducted.

And, the worm shaft 57 integrally connects the adjusting screws 49 on both end portions of the doctor roller 41. Thus, the pair of adjusting screws 49 is adjusted to the same extent simultaneously by rotating the worm shaft 57.

And, combination of the worm gear 59 and the worm wheel 53 ensures one-way power transmission. Namely, the worm wheel 53 can be rotated by rotating the worm gear 59, but the worm gear 59 can not be rotated by rotating the worm wheel 53. Therefore, when external force or vibration acts on the doctor roller 41, the worm wheel 53 is locked by the worm gear 59. As a consequence, the gap can not be changed by such external disturbance.

Further, since the controller 71 controls the drive motor 63 in the stencil printing machine of the embodiment as described above, the gap adjustment can be automatically conducted according to a value corrected by expansion changes due to atmospheric temperature.

Next, another embodiment of a stencil printing machine according to the present invention will be explained.

Figure 10:
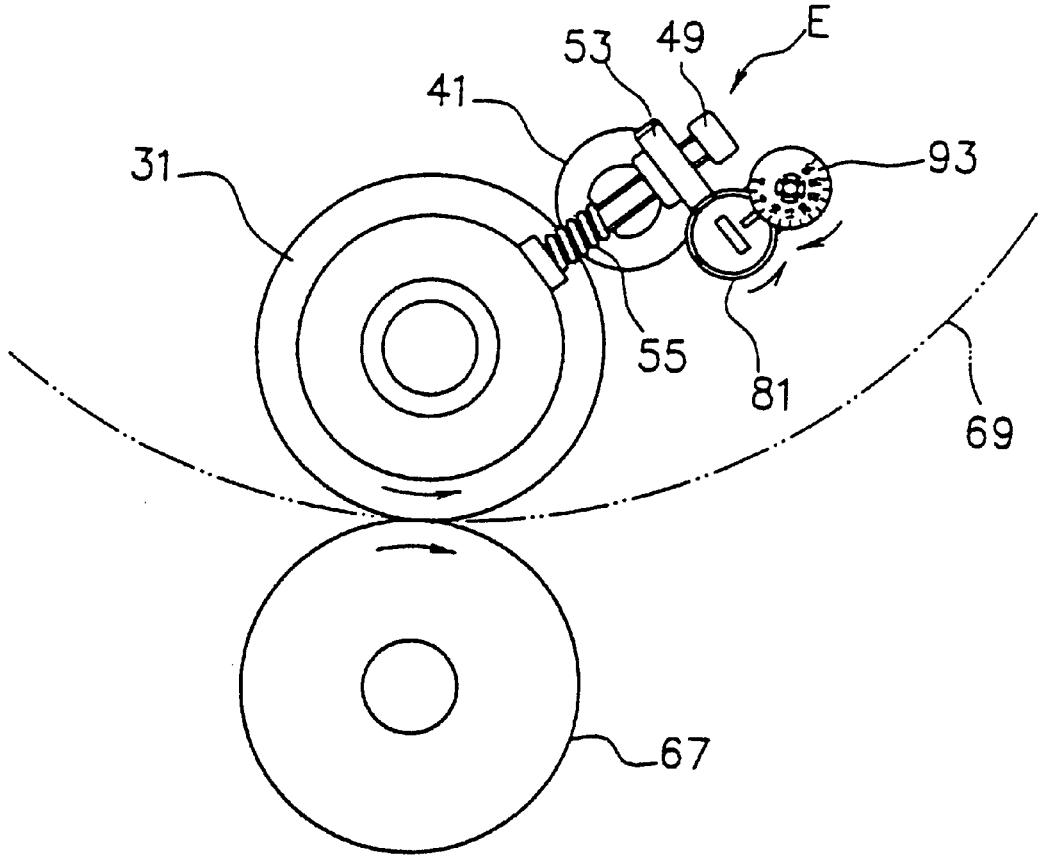
FIG. 10 is a side view of a manual driving mechanism of a stencil printing machine in another embodiment of the present invention.
Figure 11:
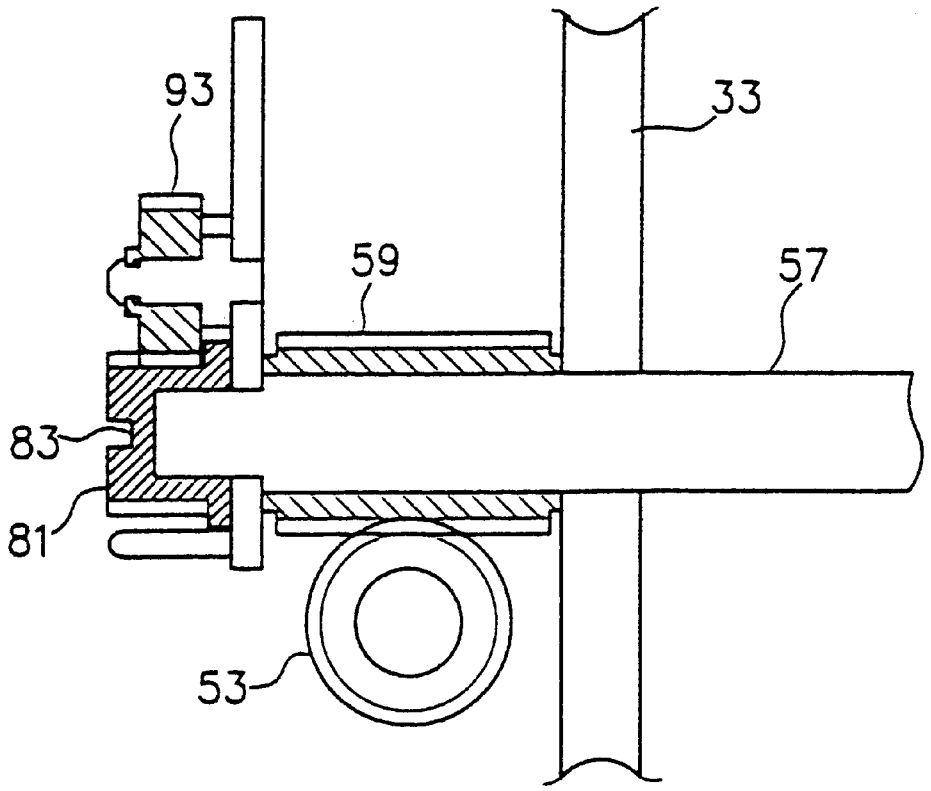
FIG. 11 is a sectional view observed in a direction "E" shown in FIG. 10.
Figure 12:
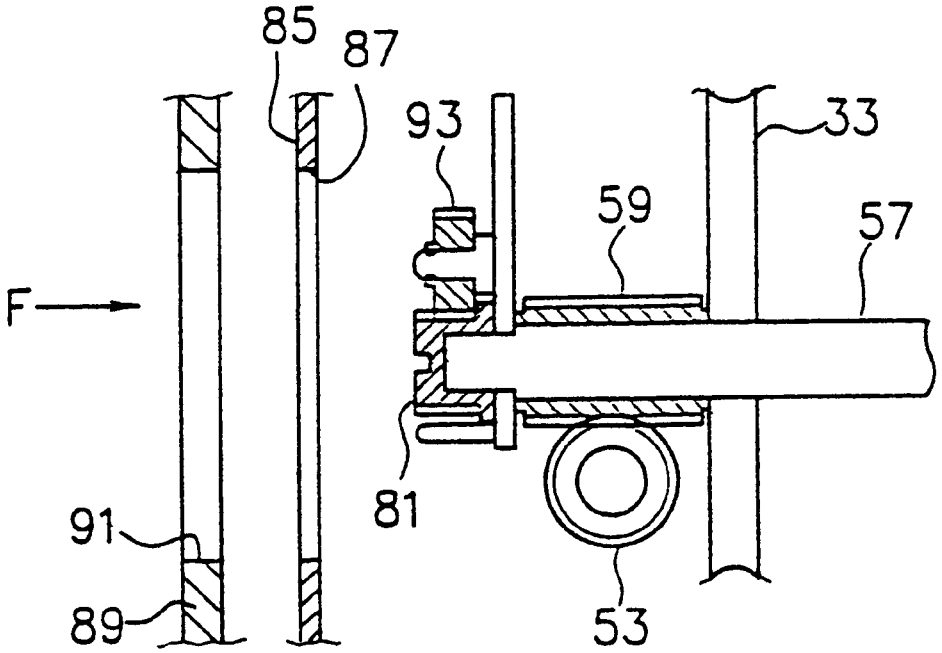
FIG. 12 is a sectional view of counting gears and the vicinity thereof showing a manually operating position.
Figure 13:
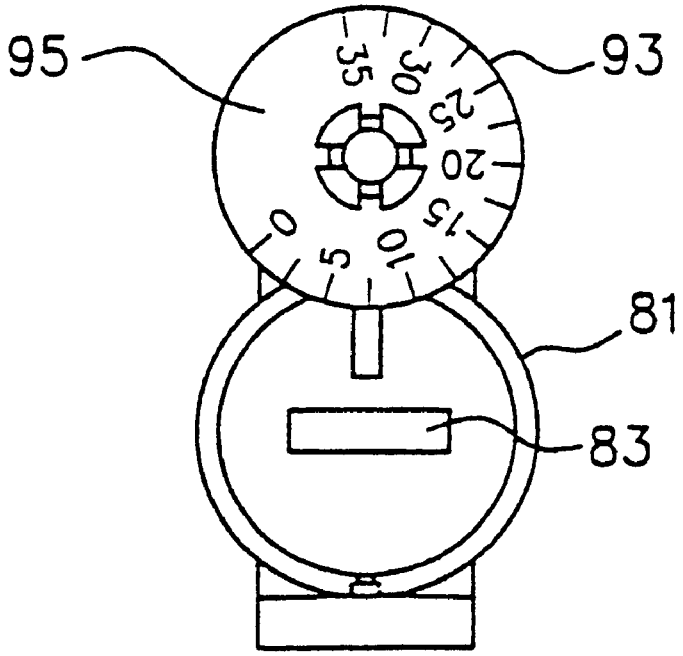
FIG. 13 is an enlarged view of the counting gears observed in a direction "F" shown in FIG. 12.
Figure 14:
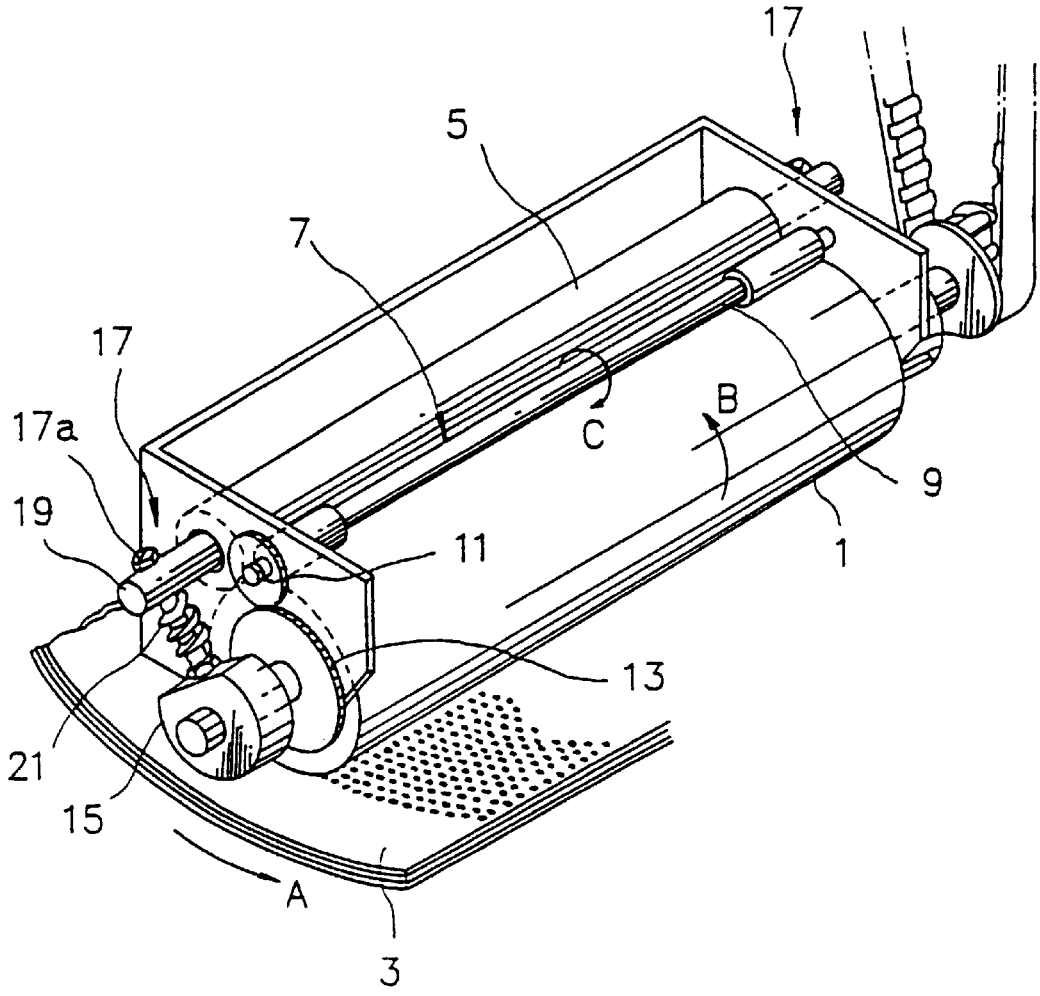
Fig. 14 Prior Art
FIG. 14 is a perspective view showing a gap-adjusting mechanism of a conventional stencil printing machine.

FIG. 10 is a side view of a manual driving mechanism of the stencil printing machine in the embodiment of the present invention. FIG. 11 is a sectional view observed in a direction "E" shown in FIG. 10. FIG. 12 is a sectional view of counting gears and the vicinity thereof showing a manually operating position. FIG. 13 is an enlarged view of the counting gears observed in a direction "F" shown in FIG. 12. Structural elements similar to those of the first embodiment illustrated in FIGS. 1 to 6 are referred to as the same reference numbers, and repetitious explanation will be omitted for clarity.

In the stencil printing machine of this embodiment, the adjusting screw 49 is manually operated unlike the first embodiment as described above where it is operated by the drive motor 63. Accordingly, in this embodiment, the drive motor 63 and the controller 71 can be omitted.

Additionally, a counting drive gear 81 is attached to the end of the worm shaft 57. The counting drive gear 81 has a groove 83 formed on a side surface thereof for engaging a screwdriver. Namely, the worm shaft 57 can be rotated by operating means such as the screwdriver engaging the groove 83.

As explained before, the printing drum has a flange 85 disposed to each of the end portions thereof. The flange 85 has an opening 87 formed in approximately the entire area thereof. And, a main frame 89 for supporting the printing drum has an operating opening 91 formed therein. Accordingly, the counting drive gear 81 can be operated to rotate, without detaching the screen from the printing drum, by the screwdriver inserted through the operating opening 91 and the opening 87 and operated from outside the printing drum.

Further, the counting drive gear 81 engages a counting follower gear 93. The counting follower gear 93 has a tooth number different from that of the counting drive gear 81 by a tooth number "n". Accordingly, when the counting drive gear 81 rotates once, the counting follower gear 93 moves rotationally by the tooth number "n". According to the rotational movement of the counting follower gear, graduations 95 for indicating the gap are formed on a surface of the counting follower gear 93. The graduations 95 can be observed from the outside of the printing drum through the operating opening 91 and the opening 87.

In this embodiment of the stencil printing machine, when the gap adjustment is required, an operator rotates the counting drive gear 81 with the operating means such as the screwdriver by a predetermined number. Then, the worm gear 59 coaxially connected to the counting drive gear 81 is rotated, thereby rotating the worm wheel engaging the counting drive gear. Rotation of the worm wheel 53 moves the adjustment screw 49 in the axial direction thereof. Thus, the doctor roller 41 pressed against the worm wheel 53 moves in the axial direction of the adjustment screw 49, so that the gap between the squeegee roller 31 and the doctor roller is changed.

Further, simultaneously with this operation, the counting follower gear 93 engaging the counting drive gear 81 rotates by the difference of the tooth number between the both counting gears. Thus, the present gap can be known by reading the graduations of the counting follower gear 95.

In the embodiments of this specification, the stencil printing machine of the outer pressing type where the press roller is vertically movable is explained; however, the present invention can be adapted to an inner pressing type where the squeegee roller moves vertically, thereby producing the same effect as that of the outer pressing type.

As has been described above in detail, in the stencil printing machine of the present invention, since the adjusting screw engages the worm wheel and the worm wheel engages the worm gear, the worm wheel is once rotated by turning the worm gear by the tooth number of the worm wheel. Even in the case where the conventional adjusting screw having a large pitch is adopted, an adjusting range of the gap is wide and a subtle adjustment of the gap is ensured to be conducted.

Further, since the worm shaft integrally connects the pair of adjusting screws, the adjusting screws can be simultaneously rotated to the same extent, so that a gap adjusting of high accuracy can be effected easily.

Further, if the drive motor is adopted as driving means for rotating the worm shaft, an automatic gap adjustment can be easily realized.

As a result of this, a stencil printing machine capable of easily conducting the gap adjusting without skilled technique can be provided.

What is claimed is:

1. A stencil printing machine, comprising:

a printing drum having a flexible ink-permeable peripheral wall adapted to receive a perforated stencil sheet around an outer circumferential surface thereof, said printing drum being rotated around a central axis thereof, a squeegee roller having an axis and situated inside said printing drum to be parallel to said central axis of said printing drum, said squeegee roller being rotated around said axis in synchronization with rotation of said printing drum with an outer circumferential surface thereof contacting an inner circumferential surface of said printing drum, a pair of bearing members attached to end portions of said axis of said squeegee roller for rotationally supporting said axis, a doctor roller having an axis and situated parallel to said squeegee roller at a predetermined distance away from said outer circumferential surface of said squeegee roller, a pair of adjusting screws situated perpendicular to said axis of said squeegee roller and fixed to said pair of bearing members, said pair of adjusting screws supporting said axis of said doctor roller so that said axis of said doctor roller is movably supported, a pair of worm wheels engaging said pair of adjusting screws, and respectively, a pair of worm gears connected together and engaging said pair of worm wheels, respectively, so that when said pair of worm gears is rotated, said pair of worm wheels is rotated simultaneously.

2. A stencil printing machine as claimed in claim 1, further comprising:

a worm shaft having said pair of worm gears fixed thereto, a counting drive gear coaxially fixed to said worm shaft, and a counting follower gear engaging said counting drive gear, said counting follower gear having a tooth number different from that of said counting drive gear and graduations for indicating a gap between said squeegee roller and said doctor roller.

3. A stencil printing machine as claimed in claim 2, further comprising operating means engaging said counting drive gear to rotate said worm shaft.

4. A stencil printing machine as claimed in claim 1, further comprising compression coil springs situated between said axis of said doctor roller and said bearing members, said axis of said doctor roller including holes formed at end portions thereof, each of said adjusting screws being inserted through said hole, so that said compression coil spring arranged between said axis of said doctor roller and said bearing member urges said doctor roller towards said worm wheel.

5. A stencil printing machine as claimed in claim 1, further comprising a driving motor connected to a worm shaft with said worm gear fixed thereto.

* * * * *